US007252246B2

(12) United States Patent
Heren et al.

(10) Patent No.: US 7,252,246 B2
(45) Date of Patent: Aug. 7, 2007

(54) OSCILLATING SPRINKLER WITH PATTERN SELECT FEATURE

(75) Inventors: Lawrence P. Heren, East Peoria, IL (US); Michael Breedlove, Hanna City, IL (US)

(73) Assignee: L.R. Nelson Corporation, Peoria, IL (US)

( * ) Notice: Subject to any disclaimer, the term of this patent is extended or adjusted under 35 U.S.C. 154(b) by 204 days.

(21) Appl. No.: 10/988,377

(22) Filed: Nov. 12, 2004

(65) Prior Publication Data

US 2006/0102751 A1 May 18, 2006

(51) Int. Cl.
*B05B 3/16* (2006.01)
*B05B 3/00* (2006.01)
*A62C 31/02* (2006.01)

(52) U.S. Cl. ..... 239/242; 239/225.1; 239/246; 239/263; 239/548; 239/551; 239/553.3; 239/553.5

(58) Field of Classification Search ..... 239/97, 239/225.1, 227, 236, 240, 242, 243, 245, 239/251, 255, 263, 390, 451–58, 391–93, 239/263.3, 71, 74, 266, 268, 429, 548–553.5, 239/561, DIG. 1, 265
See application file for complete search history.

(56) References Cited

U.S. PATENT DOCUMENTS 3,115,305 A * 12/1963 Rinkewich ..... 239/242
3,332,624 A * 7/1967 Rinkewich ..... 239/242
3,647,140 A 3/1972 Perrot et al.
4,632,313 A * 12/1986 Rinkewich ..... 239/242
5,098,020 A * 3/1992 Cooper et al. ..... 239/230
5,305,956 A 4/1994 Wang
5,350,115 A 9/1994 Burnworth et al.
5,511,727 A 4/1996 Heren et al.
5,645,218 A 7/1997 Heren et al.
5,730,366 A 3/1998 DeWitt (Continued)

FOREIGN PATENT DOCUMENTS

EP 0826 427 A2 3/1998

OTHER PUBLICATIONS

Melnor Inc. 1968 Catalog; Copyright Melnor Industries 1967.

*Primary Examiner*—Dinh Q. Nguyen
*Assistant Examiner*—James S. Hogan
(74) *Attorney, Agent, or Firm*—Brinks Hofer Gilson & Lione; Trevor K. Copeland

(57) ABSTRACT

An oscillating sprinkler having a pattern select feature. The sprinkler includes, in one embodiment, a tubular member having a plurality of spaced apart longitudinal slots thereon and an end portion having the same plurality of apertures therein. A plurality of lumens is formed inside the tubular member. A plurality of longitudinal series of nozzles extend through the spaced apart longitudinal slots. Each lumen is associated with one of said series of nozzles; one end of each lumen includes a fluid inlet and the other end of each lumen is closed. A selector piece is fitted to the tubular member and includes an opening to be aligned with a selected fluid inlet. The sprinkler further comprises a water-driven oscillating mechanism for oscillating the tubular member, wherein the oscillating mechanism includes a water inlet and a water outlet, wherein the water outlet is in fluid communication with the interior of the tubular member. Finally, a support structure for supporting the tubular member is provided.

21 Claims, 8 Drawing Sheets

U.S. PATENT DOCUMENTS 5,735,462 A * 4/1998 Roman ..... 239/242
5,845,850 A * 12/1998 Guo ..... 239/242
5,938,122 A * 8/1999 Heren et al. ..... 239/242
6,085,995 A 7/2000 Kah, Jr. et al.
6,601,781 B2 8/2003 Kah, III et al.
2002/0092931 A1 7/2002 Coote
2003/0010842 A1 1/2003 Kah, Jr.

* cited by examiner

OSCILLATING SPRINKLER WITH PATTERN SELECT FEATURE

BACKGROUND OF THE INVENTION

The present invention relates to the field of lawn and garden applications. Particularly, the present invention is directed to an oscillating sprinkler with a pattern select feature.

Various oscillating sprinkling systems are known in the art. Typically, these sprinklers provide an oscillating motor coupled to a tube having spray outlets disposed thereon. As the tube oscillates, the spray pattern moves back and forth to water a selected area of lawn. The range of back and forth movement determines the length of the watering area, and the position and orientation of the spray outlets defines the width of the watering area. Some current systems allow the range of oscillation to be adjusted to set the length of the desired watering area. In addition, certain prior systems have developed methods for adjusting the width of the spray area. However these prior art width-control systems suffer from certain disadvantages, including complexity of construction and assembly that increases manufacturing costs.

For example, certain of the prior art systems require sleeves having various nozzle-blocking patterns on them. These sleeves are mounted over the spray tube and can be rotated over some of the spray outlets, thereby adjusting the width of the spray pattern. However, if the fit between the sleeve and the spray tube is not precisely maintained, leakage occurs, diminishing the effectiveness of the system by allowing a spray pattern beyond the desired width. Leakage around the sleeve contributes to reduced water pressure to the working nozzles and puddling around the sprinkler which can have an undesired effect on the area being watered.

Other prior art sprinklers provide multiple sets of nozzles of different widths that can be selected by some adjustment of a sprinkler spray tube. However, these prior art designs typically require complex construction of the water flow tube body that is expensive and difficult to manufacture. Therefore, what is needed is an oscillating sprinkler that provides a simple water tube construction and a stepwise incremental adjusting feature allowing for a pre-selected width of a watering area.

BRIEF SUMMARY

The present invention provides a simple water tube construction in an oscillating sprinkler and a stepwise incremental pattern select feature allowing a user to choose a pre-selected width of a watering area.

In one aspect, the present invention includes an oscillating sprinkler including a fluid inlet, an oscillating mechanism, an engagement mechanism, a selector unit, an elongate tubular body member, and a support base. An internal channel leading through each of the fluid inlet, the oscillating mechanism, and the selector unit forms a first path of fluid communication. The elongate tubular body member includes a single molded body structure having connected thereto a plurality of multi-nozzle series, a plurality of lumens, each of the plurality of lumens being connected in fluid communication with at least one of the multi-nozzle series, and an end surface including a plurality of apertures, with one aperture open to each of the lumens, such that each aperture is associated with one of the plurality of lumens and at least one of the multi-nozzle series. A second path of fluid communication runs from each aperture through its associated lumen to its associated at least one of the multi-nozzle series. The engagement mechanism provides a plurality of positions for selectably providing a connection of the first path of fluid communication with one of the second paths of fluid communication, thereby providing fluid communication from the inlet to a selected multi-nozzle series.

In another aspect, the present invention includes an oscillating sprinkler having a pattern select feature including a tubular member, itself including a plurality of circumferentially spaced apart nozzle-mounting surfaces therein, with an end portion including the same plurality of apertures therein, and the same plurality of indents thereon. Each of the nozzle-mounting surfaces includes a series of nozzles associated therewith, and the interior of the tubular member includes a plurality of water conduit cavities. Each water conduit cavity is associated with one of said series of nozzles. The sprinkler also includes a generally cylindrical collar element disposed around the end portion of the tubular member and a selector piece mounted inside said collar element. The selector piece includes an opening to be aligned with a selected fluid inlet, and an outwardly biased protrusion extending towards the end portion. A water-driven oscillating mechanism for oscillating the tubular member is also included. The oscillating mechanism has a water inlet and a water outlet, wherein the water outlet is in fluid communication with an interior channel of the selector piece and wherein the oscillating mechanism causes the selector piece to oscillate, said oscillating selector piece interacting with the indent of the end portion through the outwardly biased protrusion to oscillate the tubular member. The sprinkler includes a support structure for supporting the tubular member.

In still another aspect, the present invention includes an oscillating sprinkler having a pattern select feature and including a tubular member with a plurality of circumferentially spaced apart longitudinal slots therein, and an endplate having the same plurality of apertures therein and the same plurality of indents therein. Each longitudinal slot includes a series of nozzles associated therewith, and the interior of the tubular member includes a plurality of water conduit cavities. Each water conduit cavity is associated with one of said series of nozzles. The sprinkler includes a cylindrical collar element mounted adjacent the endplate and a selector piece connected inside the collar element. The selector piece includes an opening to be aligned with a selected fluid inlet and an outwardly biased protrusion extending towards the endplate, wherein the opening on the selector piece comprises a cylindrical portion having an internal step, a sealing cup fitted within the cylindrical portion, an o-ring between the internal step and the sealing cup, and a rubber seal extending out from the sealing cup towards the endplate. In addition, the sprinkler includes a water-driven oscillating mechanism for oscillating the tubular member, wherein the oscillating mechanism includes a water inlet and a water outlet, and wherein the water outlet is in fluid communication with the interior of the collar element. The sprinkler is constructed such that when the oscillating mechanism causes the selector piece to oscillate, the oscillating selector piece interacts with the indent of the endplate through the outwardly biased protrusion to oscillate the tubular member. The sprinkler also includes a support structure for supporting the tubular member.

In yet another aspect, the present invention includes an oscillating sprinkler having a pattern select feature and comprising a tube body. The tube body includes a plurality of tubes, each of which has a series of nozzles associated therewith, and an end having the same plurality of apertures therein, with each aperture opening into one of the plurality of tubes, and the same plurality of engagement surfaces thereon. The sprinkler has a cylindrical collar element disposed around the end of the tube body with a selector piece mounted inside said collar element. The selector piece includes an opening to be aligned with a selected aperture, and includes an outwardly biased protrusion extending toward the end for engaging one of the engagement surfaces thereon. The sprinkler also has a water-driven oscillating mechanism for oscillating the tube body, wherein the oscillating mechanism includes a water inlet and a water outlet, and wherein the water outlet is in fluid communication with the interior of the collar element such that when the oscillating mechanism causes the selector piece to oscillate, the oscillating selector piece interacts with the engagement surface of the end through the outwardly biased protrusion to oscillate the tube body. The sprinkler also includes a support structure for supporting the tube body.

In still yet another aspect, the invention includes an oscillating sprinkler having a pattern select feature and including a water-dispensing body that itself includes a plurality of tubes, each tube having a series of nozzles associated therewith, an end surface having the same plurality of apertures therein opening into one of said plurality of tubes, and a detent projection on the end surface. The sprinkler has cylindrical collar element mounted around the end surfaces of the tube body and a selector piece fitted inside said collar element. The selector piece comprises an opening to be aligned with a selected aperture and plurality of detent-receiving indents thereon for receiving the detent projection, wherein the opening on the selector piece comprises a cylindrical portion having an internal step, a sealing cup fitted within the cylindrical portion, an o-ring between the internal step and the sealing cup, and a rubber seal extending out from the sealing cup towards the selected end surface. Additionally, the sprinkler includes a water-driven oscillating mechanism for oscillating the tubular body. The oscillating mechanism includes a water inlet and a water outlet, wherein the water outlet is in fluid communication with the interior of the collar element and wherein, when the oscillating mechanism causes the selector piece to oscillate, the oscillating selector piece interacts with the detent projection of the end surface through the detent receiving indent to oscillate the tubular body. The sprinkler also has a support structure for supporting the tubular body.

In still another aspect, the present invention includes an oscillating sprinkler that itself includes a tubular member having a first number of nozzle mounting slots thereon and an end portion having substantially the first same number of apertures therethrough. Each of the nozzle mounting slots includes a series of nozzles associated therewith, and the interior of the tubular member includes a plurality of lumens. Each lumen is associated with one of the series of nozzles and with one of the apertures. The sprinkler also includes a selector unit comprising a fluid passage selectably in communication with each of the plurality of lumens and an engagement mechanism. The engagement mechanism is selectably engageable with the end portion of the tubular member in one of at least two engagement positions. A fluid-driven oscillating mechanism for oscillating the tubular member is also part of the sprinkler. An oscillating movement of the oscillating mechanism causes the selector unit to oscillate, such that the oscillating selector piece interacts with the engagement mechanism to oscillate the tubular member.

In yet another aspect, the present invention includes an oscillating sprinkler having a pattern select feature and including a tubular member with a plurality of spaced apart longitudinal slots therein, a first end having the same plurality of apertures therein, the same plurality of indents therein, a closed end, and a plurality of water conduit cavities. Each water conduit cavity is associated with one of the longitudinal slots. A plurality of strips of nozzles for each of said longitudinal slots is also include and an interior side of each of the strips comprises a means for securing the strip to a longitudinal slot and an exterior side of the strips comprises outwardly projecting nozzles. The sprinkler includes a cylindrical collar element over the first end of the tubular member. A selector piece is fitted inside said collar element. The selector piece includes an opening to be aligned with a selected aperture and an outwardly biased protrusion extending towards the first end of the tubular member. The sprinkler also includes a water-driven oscillating mechanism for oscillating the tubular member, wherein the oscillating mechanism itself includes a water inlet and a water outlet. The water outlet is in fluid communication with the interior of the collar element. The sprinkler is constructed such that the oscillating mechanism causes the selector piece to oscillate, so that the oscillating selector piece interacts with the indent of the first end through the outwardly biased protrusion to oscillate the tubular member. A support structure for supporting the tubular member is also included as part of the sprinkler.

It is to be understood that both the foregoing brief description and the following detailed description are exemplary and are intended to provide further explanation of the invention claimed. The accompanying drawings, which constitute part of this specification, are included to illustrate and provide a further understanding of embodiments of the invention.

DETAILED DESCRIPTION OF EXEMPLARY EMBODIMENTS

The embodiments of the invention presented herein are useful for dispensing water from an oscillating sprinkler over an area to be watered such as, for example, a lawn or garden area. Embodiments of the present invention are particularly suited for an application in which it is desirable to select the width of the area to be watered.

Figure 1:
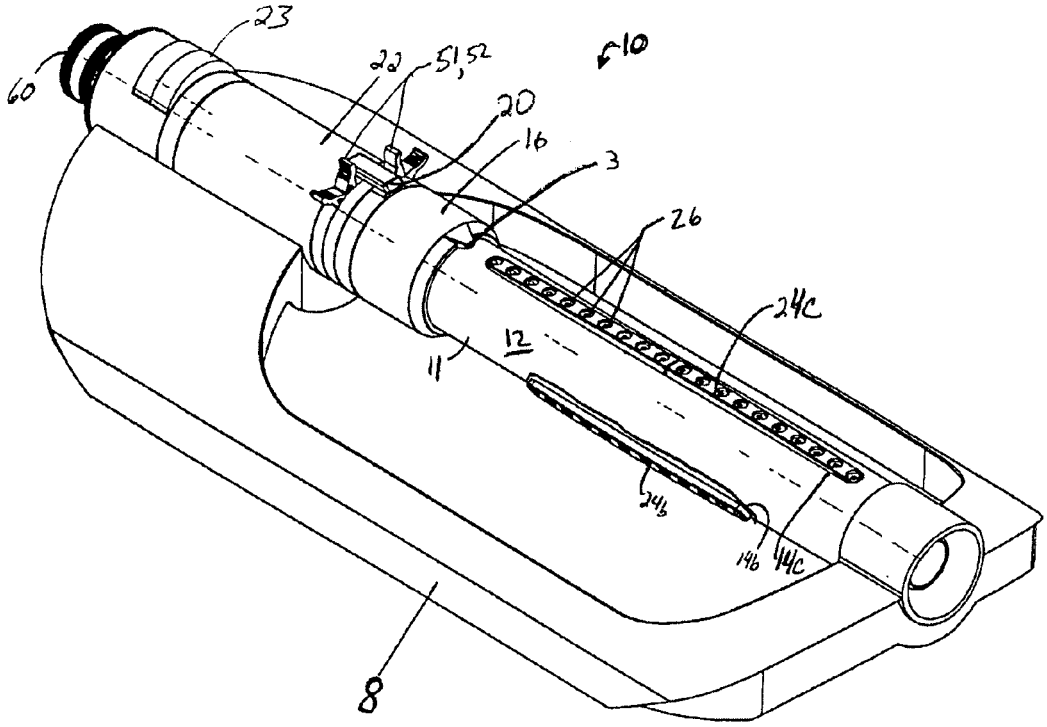
FIG. 1 shows one embodiment of an oscillating sprinkler of the present invention.

One embodiment of an oscillating sprinkler 10 according to the invention is illustrated in FIG. 1. The sprinkler 10 includes a flow tube assembly 12. The body 11 of the flow tube assembly 12 in the illustrated embodiment is a single molded plastic body 11. The elements of the body 11 of the flow tube assembly 12 are more clearly shown in FIGS. 2-4. The flow tube body 11 includes three longitudinal lumens (or water conduit cavities) 32*a*-32*c* that are open through apertures 33*a*-33*c* on the proximal end portion 30 of the body 11, and closed on the distal end of the body 11. The flow tube assembly 12 includes a plurality of longitudinal slots 14 disposed thereon (the slots are designated in the figures as 14*a*-14*c*). Each longitudinal slot 14 includes disposed therein a multi-nozzle series 24 (the multi-nozzle series are designated in the figures as 24*a*-24*c* and correspond, respectively, to the slots 14*a*-14*c*). Each multi-nozzle series 24 includes a plurality of individual nozzles 26 protruding therefrom. Nozzle assembly embodiments that may be used in the sprinkler shown in FIG. 1 are illustrated in greater detail in FIGS. 6-9.

Figure 2:
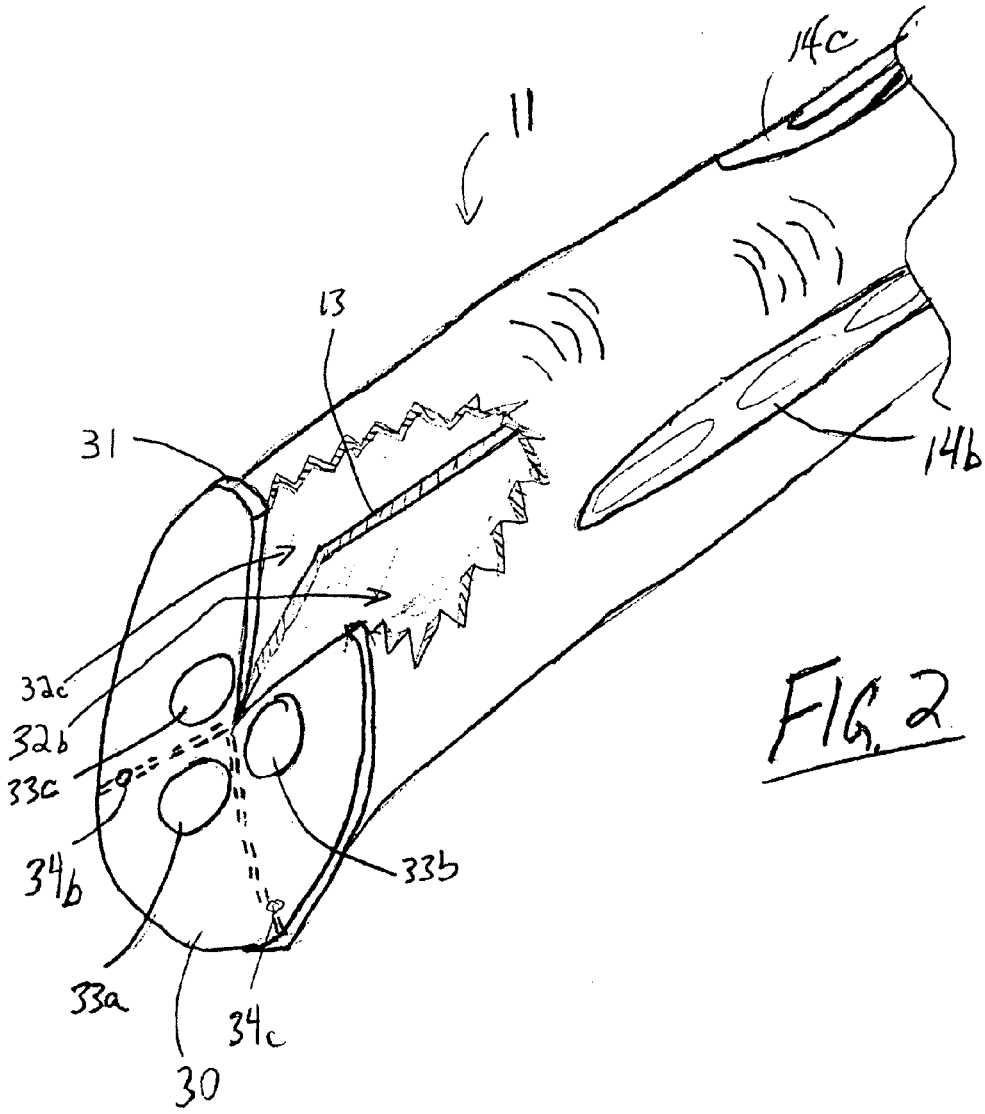
FIG. 2 is a partially cut-away perspective view of one embodiment of a flow tube body.

In the illustrated embodiment, the lumens 32*a*-32*c* and the nozzle mounting slots 14 are formed during injection molding of the body 11 of the flow tube assembly 12. The construction of the body 11 of the flow tube assembly 12 is illustrated in FIG. 2, which shows a partial cutaway perspective view of the body 11 without any nozzle series 24 or other components assembled to it. The lumens 32 are defined by dividers 13 extending radially from the central longitudinal axis of the body 11 of the flow tube assembly 12. The simplicity of this one-piece injection-molded design presents manufacturing and cost savings efficiencies.

In some alternative embodiments, the nozzles 26 may not be separate structures that protrude from nozzle series 24 mounted to the flow tube assembly 12, but may be constructed as nozzle apertures in the flow tube assembly 12 that are open to allow water flow. Such construction may include, for example, drilling the nozzle apertures or molding the apertures as an integral part of the body 11 of the flow tube assembly 12. Attachment of the multi-nozzle series 24 to the flow tube assembly 12 in the illustrated embodiment of FIG. 1 is described below in connection with FIGS. 6-9. According to the invention, each of the multi-nozzle series 24 provides a different width of spray pattern that can be selected by a user in accordance with the description herein. The sprinkler 10 also includes an oscillating mechanism 22. The oscillating mechanism may be, for example, one of the oscillating mechanisms described in U.S. Pat. Nos. 5,511,727, 5,645,218 and 5,938,122, each of which is assigned to L.R. Nelson Corporation of Peoria, Ill., and incorporated herein by reference.

Figure 3:
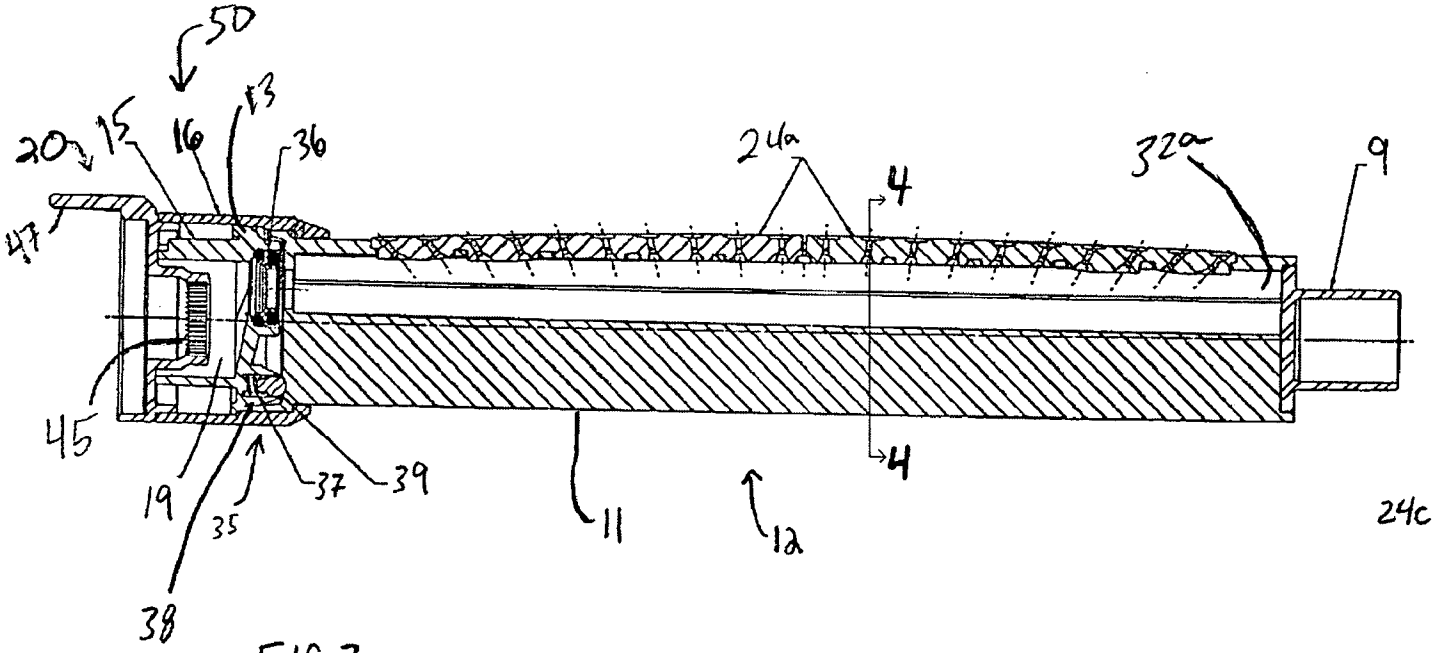
FIG. 3 is a longitudinal cross-sectional view of an embodiment of a flow tube body, bale element, and selector module.
Figure 5A:
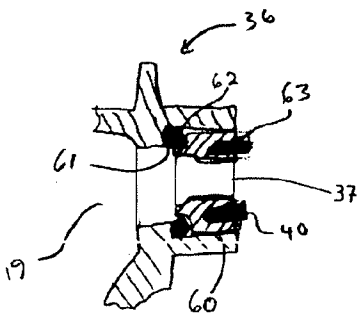
FIG. 5A is a detail of FIG. 5 showing a cross-sectional view of an engagement and sealing portion of the selector module.
Figure 5:
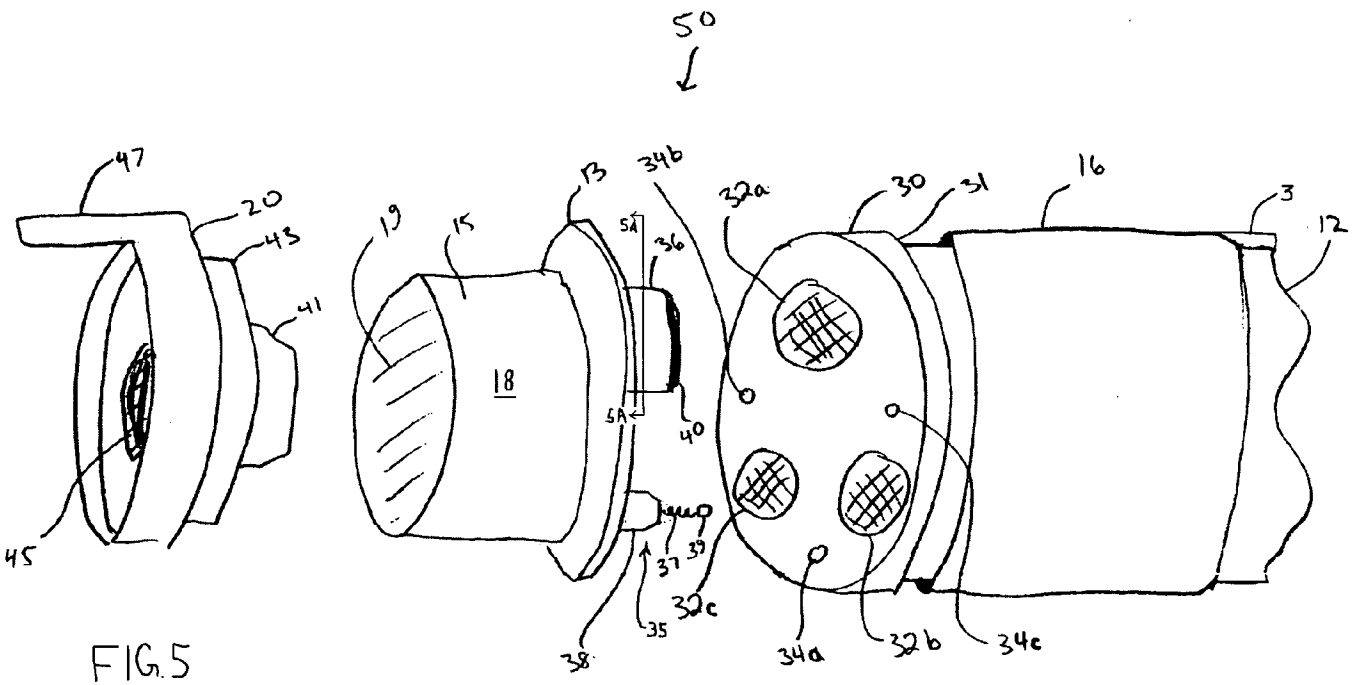
FIG. 5 is an exploded view of a coupling system of the embodiment depicted in FIG. 1, including the bale element, the selector module, a collar element, and a proximal portion of the flow tube body.

As shown in FIG. 1, and in more detail in FIGS. 3 and 5, the sprinkler 10 includes an engagement/coupling system 50, which, in the illustrated embodiment, fulfills the dual purposes of (1) coupling the oscillating mechanism 22 to the flow tube assembly 12, and (2) allowing for selection of a desired spray pattern. In this embodiment, a timing mechanism 23 is included to allow a user to set the sprinkler 10 to shut off automatically at a pre-selected time. Finally, the sprinkler 10 also includes a supporting base 8 which is connected near the proximal (inlet) end of the sprinkler 10 to a body housing the oscillating mechanism 22 and a timer module 23, and at the distal end to a connector 9 extending from the flow tube assembly 12. The shape of the supporting base 8 may vary greatly in alternative embodiments and may connect to the body of the sprinkler 10 at other points. For example, it may connect near the proximal end to a flow control module, which is optionally included in another embodiment of the sprinkler 10. In yet another embodiment, the flow tube assembly may not have a distal attachment.

Figure 4:
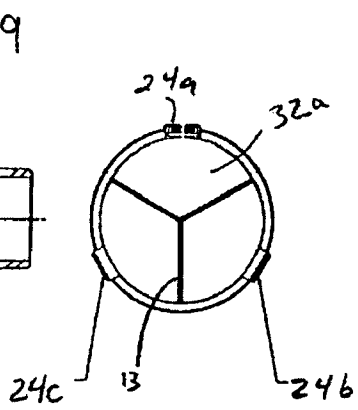
FIG. 4 is a transverse cross-sectional view along line 4-4 of the flow tube shown in FIG. 3.

According to the embodiments shown in FIGS. 1-5, the spray pattern is selected by rotating the flow tube assembly 12 into one of three detent-secured positions such that the desired series of nozzles 24 is aligned with a flow indicator marker 3. This feature is implemented through the coupling system 50, described below with reference to FIGS. 3 and 5. The flow tube assembly 12 includes an end portion embodied as an endplate 30 having a plurality of apertures 33*a*-33*c* opening to lumens 32*a*-32*c* therein, wherein each lumen 32*a*-32*c* provides fluid communication through the interior of the flow tube assembly 12 to each of the multi-nozzle series 24*a*-24*c*, respectively. FIG. 4 illustrates a transverse cross-section of the flow tube body 11 along line 4-4 of FIG. 3, and shows the relative placement of the lumens 32. As illustrated, the endplate 30 is an integral part of the flow tube assembly 12 and includes a flange 31. In one alternative embodiment, the end portion 30 is an end cap that is assembled to the flow tube assembly 12. The end surface/end portion 30 may alternatively be embodied as a set of wholly open apertures sized to receive water flow coming from the inlet to a selected lumen. In yet another alternative, the end portion 30 and its associated apertures/inlets may include openings on one or more sides of the flow tube body 11, with appropriate structure provided from the inlet to provide water flow to the lumens/water conduit cavities.

As shown in FIGS. 1, 3, and 5, the coupling system 50 includes a collar element 16 that secures the coupling system 50 to the endplate 30 of the flow tube body 11. When assembled, a distal portion of the collar element 16 engages the flange 31 of the flow tube assembly 12. As part of the coupling system 50, a selector module 18 is disposed inside the collar element 16. In this embodiment, the selector module 18 is attached to the collar element 16 by a tab engaging a notch (not shown) in the collar 16. The selector module 18 includes a distal flange 13 and a cylindrical body portion 15 oriented toward the proximal end of the sprinkler 10. The cylindrical body portion 15 of the selector module 18 includes an interior lumen 19 that is in fluid communication with the water transport passage extending from the water inlet 60 (see FIG. 1). A fluid outlet port 36 is disposed on the distal side of the flange 13. The collar 16 includes visual indicia for selecting a desired nozzle set 24 in the form of a flow indicator marker 3 that is aligned with the fluid outlet port 36 of the selector module 18.

As shown in FIG. 5A, which is a longitudinal cross-sectional view along line 5A-5A of FIG. 5, the fluid outlet port 36 includes several components for maintaining a fluid-tight seal between the selector module 18 and the body 11 of the flow tube assembly 12 when they are engaged. The fluid outlet 36 is designed with a cylindrical wall 60 having an internal step 61. An o-ring 62 is provided on the step 61, and a sealing cup 63 is fitted into the cylinder over the o-ring 62. A rubber seal 40 is fitted into and extends out from the sealing cup 63. The use of the o-ring 62 and sealing cup 63 also act as a spring exerting pressure from the fluid outlet 36 against the endplate 30. This additional pressure helps frictionally to engage and seal the selector piece 18 with the endplate 30 to prevent water leakage therebetween.

The lumen 41 of the fluid outlet port 36 provides fluid communication between the interior lumen 19 of the selector module 18 and, selectably/individually, the lumens 32*a*-32*c* of the flow tube assembly 12. The fluid outlet port 36 is located on the selector module 18 so as to selectably align with one of the apertures 33*a*-33*c* opening into lumens 32*a*-32*c* and to direct fluid into a selected one of the lumens 32*a*-32*c*. The o-ring 62, seal cup 63, and rubber seal 40 provide a seal between the distal end of the fluid outlet port 36 and the proximal end of the endplate 30. Those of skill in the art will appreciate that alternative structures, within the scope of the present invention, may be used to provide a seal between the distal end of the fluid outlet port 36 and the proximal surface 30 of the flow tube body 11.

FIG. 5A illustrates the coupling system 50, which includes the interface between the selector module 18 and the endplate 30. The distal side of the flange 13 of the selector module 18 includes an engagement mechanism with an engagement structure embodied as a protruding detent button assembly 35. The base of the detent button assembly 35 is a spring mount 38. In the illustrated embodiment, the spring mount 38 allows the mounting of a spring 37 which includes a plastic nub 39 on its distal end. The spring mount 38 is located on the selector module 18 to selectably align with one of the indents 34 located on the end portion 30. When the spring mount 38 is aligned with one of the indents 34, the spring 37 biases the nub 39 into engagement with that indent 34, and the fluid outlet port 36 aligns with a corresponding one of the lumens 32*a*-32*c*.

For example, in the illustrated embodiment, the longest nozzle series is the nozzle series 24*a* which consists of two multi-nozzle strips. A user wishing to select the nozzle series 24*a* for a desired water pattern width will rotate the flow tube assembly 12 until the flow indicator marker 3 is aligned with the nozzle series 24*a*. As the flow tube 12 is rotated into this position, the detent button mechanism 35 is aligned with indent 34*a*, the spring 37 biases the nub 39 into engagement with the indent 34*a*, and the fluid outlet port 36 aligns with the lumen 32*a*, providing fluid communication from the inlet through the timer 23, the oscillator 22, then via the lumen 19 and the outlet port 36 of the selector module 18 through the aperture 32*a* and lumen 33*a* to the multi-nozzle series 24*a*.

The detent button 35 provides audible and tactile feedback to the user by "clicking into place" into one of the indents 34-34*c* when the user rotates the flow tube assembly 12 to a selected position. This helps to ensure that the fluid outlet port 36 is aligned with the desired lumen 32*a*-32*c*. Also, the detent button 35 is sufficiently strongly biased into engagement with indents 34*a*-34*c* of the endplate 30 on the flow tube assembly 12 that, when the sprinkler 10 is in operation, the oscillating motion of the mechanism 22 is effectively transmitted through the selector module 18 to the flow tube assembly 12, so that the flow tube assembly 12 oscillates. In the illustrated embodiment, the positioning of the engagement mechanism complements alignment of the desired multi-nozzle series 24*a*-24*c* with the visual indicia 3 on the collar 16. In alternative embodiments, these visual indicia are not present, or some other visual indicia may be used alone and/or to complement the "clickable" indicia of the above-described engagement mechanism.

In an alternative embodiment, two detent button assemblies 35 may be provided and positioned to align with a selected two of the indents 34, providing a more stable lock while the fluid outlet port 36 is aligned with a corresponding one of apertures 32. In alternative embodiments, the nub 39 may be constructed of rubber or some other material, or may be a ball bearing. Those of skill in the art will appreciate that other embodiments of an engagement mechanism are within the scope of the present invention. For example, a different embodiment of an engagement mechanism such as one having a different number of engagement structures or a ratcheting mechanism may be used. Those of skill in the art will also appreciate that such engagement structures also may be located in other places and/or orientations. For example, one embodiment of an engagement structure may include a tang and/or leaf spring assembly disposed on the proximal or distal end of the flow tube assembly 12, and engageable in a manner to align a selected one of the lumens/nozzle assemblies with the input water passage. The embodiment illustrated in FIGS. 11-14 below serves as another example of one embodiment of an engagement structure within the scope of the present invention.

As shown in FIG. 5, the coupling system 50 also includes a bale element 20 which connects the selector module 18 and collar element 16 to the oscillating mechanism 22. The bale element 20 includes an outlet 41 that extends into the interior lumen 19 of the selector module 18. The outlet 41 is in fluid communication with the inlet/channel 45. A cylindrical portion 43 extends from the body of the bale element 20 and is attached to the inside of the collar element 16 by, for example, a weld. The interior of the inlet/channel 45 is ribbed to engage a complementarily ribbed distal end of the oscillating mechanism 22 (ribbed portion of the oscillating mechanism 22 not shown). Thus, as the oscillating mechanism 22 rotates, the bale element 20 rotates, which rotates the collar element 16 and the selector module 18, causing the flow tube assembly 12 to oscillate as described above.

The sprinkler 10 comprises collars 51, 52 which can be set to vary the range of the oscillation, a process known in the art and described more fully in the patents previously incorporated herein by reference. The bale element 20 is provided with an extension 47 that is arranged between the collars 51, 52. When the bale element 20 oscillates, the extension 47 oscillates until it meets one of the collars, e.g., collar 51. Thereupon, the rotation of the bale element 20 is impeded, and the impediment is received by the oscillating mechanism 22, which reverses itself. The oscillating mechanism 22 then causes the bale element 20 to oscillate in the opposite direction until impeded by collar 52, and then reverses again.

The sprinkler 10 further includes an inlet 60 for connection to a hose (not shown). The inlet 60 is in fluid communication with a channel through the oscillating mechanism 22, which is driven by the flow of water. Other embodiments of the invention may include a flow control module arranged between the inlet 60 and the oscillating mechanism 22.

In a sample operation of the embodiment of the sprinkler 10 illustrated in FIGS. 1, a stream of water enters the inlet 60 at the proximal end of the sprinkler 10. The water passes through a continuous first fluid communication path through the timer 23, the oscillating mechanism 22 (causing oscillation as described above), and the selector module 18 (disposed in collar 16). The water exits the selector module 18 through the outlet port 36 and enters a second fluid communication path including passing through the selected aperture 33*b* into the selected lumen 32*b* of the flow tube assembly 12, and exits the multi-nozzle series 24*b* to spray the selected watering area.

Each of the multi-nozzle series 24 can be secured to the flow tube assembly 12 in a variety of ways. It is preferable to provide a seal that prevents leakage through the longitudinal slots 14. FIGS. 6-7 and 8-9 illustrate, respectively, detail views of two ways that the multi-nozzle series 24 may be mounted to a portion of the body 11 of the flow tube assembly 12. In the embodiments depicted in FIGS. 6-7, the nozzle series 24 includes one or more strips 1, which are attached to the flow tube assembly 12 in the slots 14. As shown in a first embodiment in FIGS. 6-7, the longitudinal slot 14 contains a series of apertures 2 adapted to hold a series of nozzle couplets 4 (making up from one of the multi-nozzle series 24) molded in the strip 1 and depending downward towards the interior of the flow tube assembly 12. In operation, the apertures 2 and nozzle couplets 4 increase the surface area of bond between the nozzle series 24 and the longitudinal slot 14 and thereby provide a more effective seal. Other embodiments consistent with the scope of the invention may dispense with the apertures 2 and/or the nozzle couplets 4 by, for example, having the multi-nozzle series 24 embodied as a series of drilled, molded, or otherwise formed apertures in the surface of the flow tube assembly 12. In other alternative embodiments, the number of apertures 2 may vary and the nozzle couplets 4 may be nozzle singlets, triplets, or other variants.

Figures 6, 7, 8, 9:
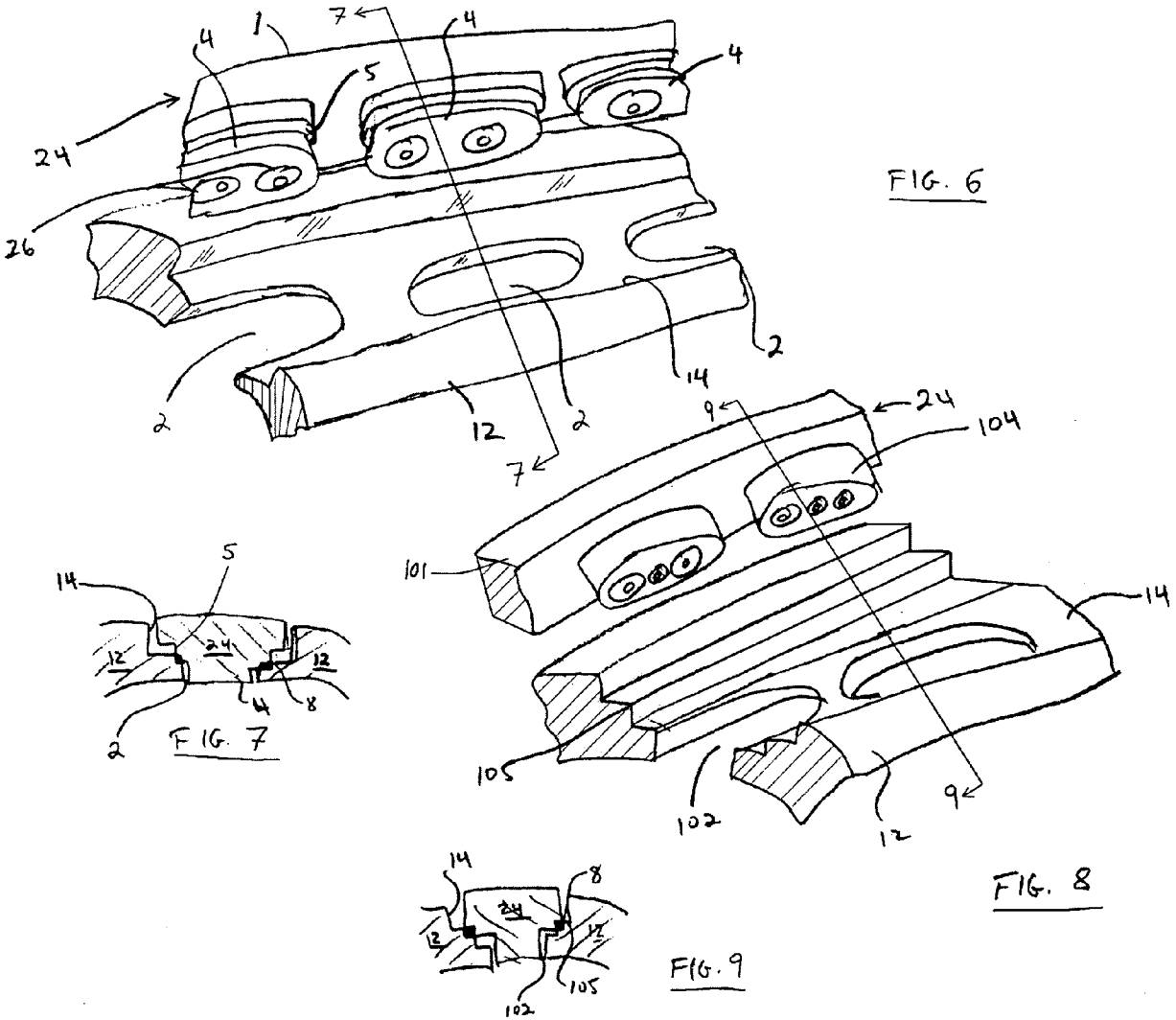
FIGS. 6-7 illustrate one embodiment of a nozzle assembly.
FIGS. 8-9 illustrate another embodiment of a nozzle assembly.

FIG. 7 illustrates an enlarged cross-sectional view of FIG. 6 along line 7-7, with the strip 1 assembled to the flow tube assembly 12. In the embodiment shown in FIGS. 6-7, the nozzle couplets 4 of the illustrated embodiment are provided with a stair-step 5. As shown in FIG. 7, the stair-step 5 contacts the edge of the aperture 2 and provides a juncture of sealing attachment 8 between each nozzle couplet 4 of the multi-nozzle series 24 and flow tube assembly 12. The seal is provided, for example, by providing glue, a snap-fit, or a sonic weld along the junction 8.

The embodiment illustrated in FIGS. 8-9 differs from the embodiment of FIGS. 6-7 in that it does not have a stair-step on the nozzle structures, which are affixed to the strip 101. FIG. 9 illustrates an enlarged cross-sectional view of FIG. 8 along line 9-9, with the strip 101 assembled to the flow tube assembly 12 such that each of the nozzle triplets 104 extends into the apertures 102. In this embodiment, a stair-step 105 is provided as part of the longitudinal slot 14 to provide a different, but similarly effective, junction 8 at which, for example, glue, sonic welding, snap-fitting or some other affixation method/structure between each nozzle triplet 104 of the multi-nozzle series 24 on the strip 101 and the flow tube assembly 12.

In yet another alternative embodiment, a strip holding a multi-nozzle series 24 may be attached into the flow tube assembly 12 from the inside, with—for example—glue, sonic welding, and/or water pressure during operation providing a seal between the strip and the longitudinal slots. The described types of nozzle construction and mounting are known to those of skill in the art.

Figure 10:
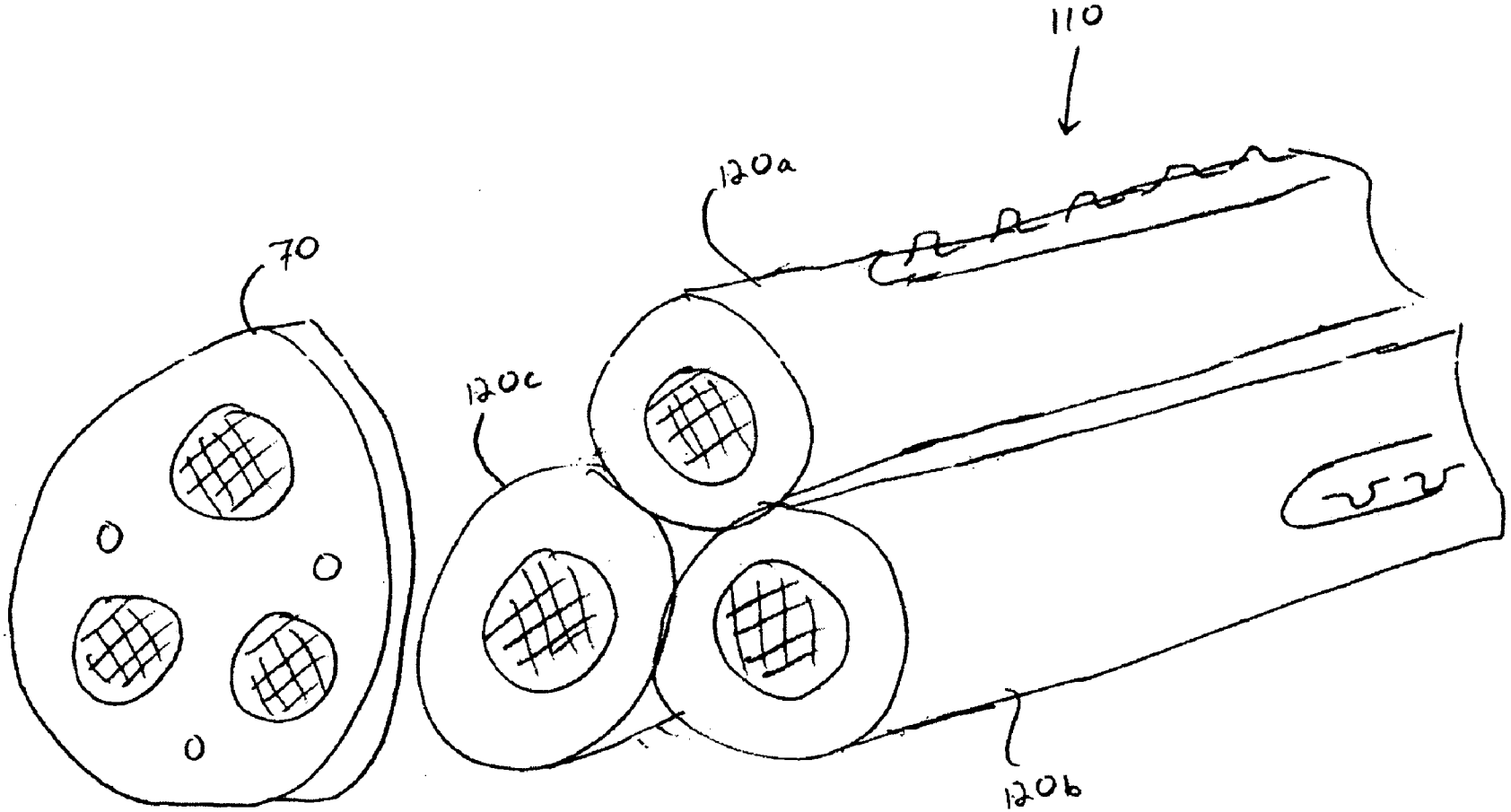
FIG. 10 shows a portion of another embodiment of a flow tube assembly of the present invention.

An alternative to the single-tube flow tube assembly 12 is illustrated in FIG. 10 as a multiple flow tube assembly 110. The multiple flow tube assembly 110 includes a series of tubes 120*a*-120*c*. This embodiment provides separate tubes 120, each having at least one central water lumen rather than having a singular tubular member with a series of interior water lumens separated by dividers (e.g., the body 11 of the flow tube assembly 12 shown in FIGS. 1-5). The tubes 120 are joined by, for example, gluing, welding, banding, or some other chemical or mechanical connection. In the illustrated embodiment, an end portion/end cap 70 is provided and attached to the tubes 120 such that the functioning of the water flow, engagement mechanism, and oscillation is similar to the embodiments discussed with reference to the sprinkler 10. The multi-tubular body 110 is rotatable to select the tube 120 having the desired spray pattern. Each tube 120 includes its own nozzle series, which confers a different spray pattern, and placement of the nozzle series can be implemented as herein previously described. In an alternative embodiment, the multiple flow tube assembly 110 may be constructed without an end portion/end cap 70. Instead, the proximal end of each of the tubes 120 is constructed to selectably engage with the selector module 18.

Figure 11:
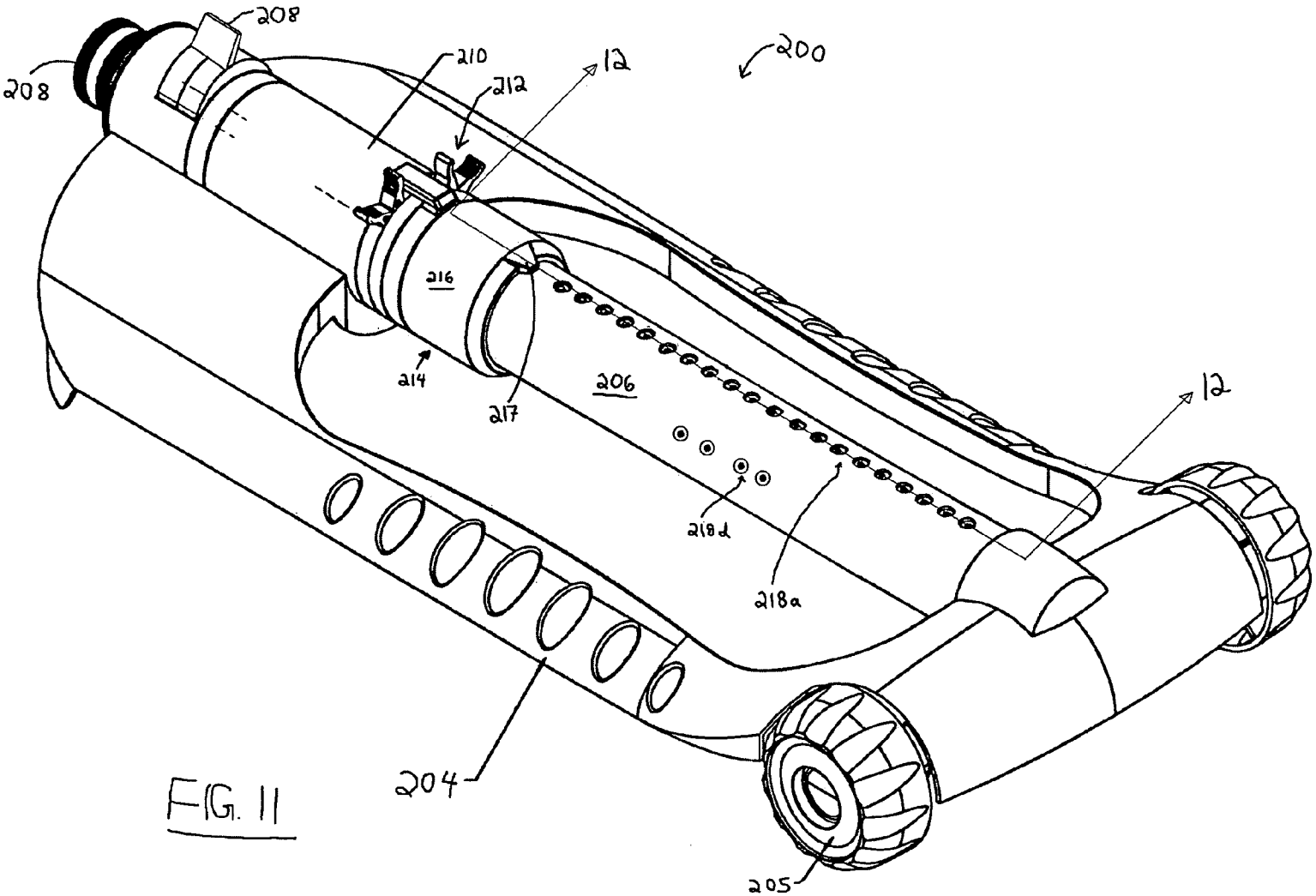
FIG. 11 shows a perspective view of another embodiment of the present invention.

FIGS. 11-14 illustrate another embodiment of the present invention as a sprinkler 200 having a pattern select mechanism. Variations of features incorporated in this embodiment may also be used with the embodiments described above. FIG. 11 is a perspective view of the sprinkler 200. The sprinkler 200 includes a proximal inlet 202, a base 204 (with wheels 205), and a flow tube body 206. A flow control module 208, a water-impelled oscillator motor 210, a pattern length control mechanism 212 (having a bale and two water pattern length adjusting structures; see, e.g., the collars 51, 52 and the tab 47 in the embodiment of claim 1), and a selector module 214 (attached inside a collar 216, which includes a pointer structure 217) are located between the inlet 202 and the flow tube body 206. Four sets of nozzles 218*a*-218*d* are formed in the surface of the flow tube body 206. As illustrated, the nozzle sets 218 are molded as apertures during a molding step for making the flow tube body 206. In alternative manufacturing processes, the nozzle sets 218 may be, for example, drilled out after the flow tube body 206 is molded, installed as discrete single-nozzle units, or placed in strips and installed to pre-formed mounting openings. The nozzles may be made of metal, polymer, or another material suitable for providing the desired spray properties. In the illustrated embodiment, the nozzles are in a longitudinal linear series; however, in alternative embodiments, the nozzles may be in a zig-zag or staggered pattern or some other arrangement.

Figures 12, 13, 14:
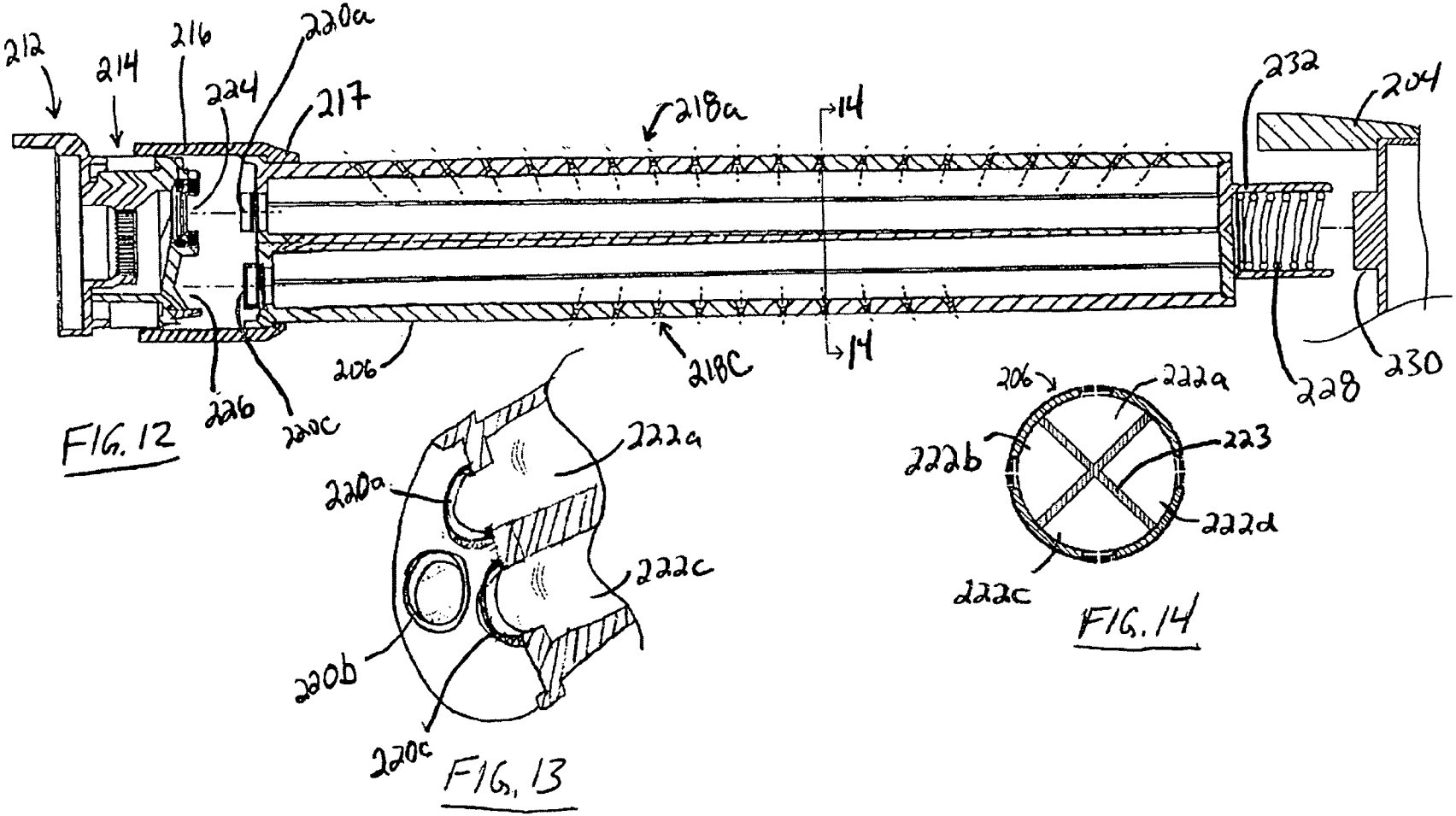
FIG. 12 is a partially exploded, longitudinal cross-sectional view of another embodiment of a flow tube body, bale element, selector module, and a portion of the sprinkler base.
FIG. 13 is a detailed partial cross-sectional view of the proximal end of the flow tube body of FIG. 12.
FIG. 14 is a transverse cross-sectional view along line 14-14 of the flow tube embodiment of FIG. 12.

FIG. 12 shows a partial view of a cross-section along line 12-12 of FIG. 11. While the external appearance of the sprinkler 200 is similar to the sprinkler shown in FIG. 1, the engagement mechanism of this embodiment differs from the sprinkler embodiment 10 illustrated in FIG. 1. The flow tube body 206 includes four protruding male inlet ports 220*a*-220*d*, each of which opens into a corresponding lumen 222*a*-222*d*. The lumens 222—separated by dividing walls 223—are more clearly shown in FIG. 14, which is a transverse cross-sectional view along line 14-14 of FIG. 13. The inlet ports 220 are more clearly shown in FIG. 13, which is a partial cross-sectional perspective view of the proximal end of the flow tube body 206. Those lumens 222*a*-222*d* are open to corresponding nozzle sets 218*a*-218*d*.

The selector module 214 includes one female outlet port 224 and three "dummy" female ports 226. The female outlet port 224 is open to a fluid communication channel from the inlet 202. The female outlet port 224 includes a sealing structure (e.g., an o-ring or sealing membrane) that enables it to form a fluid-tight seal when engaged with a selected one of the inlet ports 220*a*-220*d*. The female outlet port 224 is aligned with the pointer 217 on the collar 216, which is attached to the selector module 214. The three dummy ports 226 are sized and positioned to complementarily receive the inlet ports 220 that are not engaged with the outlet port 224. For example, when inlet port 220*a* is engaged with the outlet port 224 allowing water flow from the inlet 202 to proceed via the lumen 222*a* to the nozzle set 218*a*, the inlet ports

220*b*-220*d* will be engaged with the dummy ports 226 and closed off from water flow. The inlet ports 220 of the flow tube body 206 are biased into engagement with the outlet 224 and dummy ports 226, in the illustrated embodiment, by a coil spring 228 compressed between the distal end of the flow tube body 206 and the base 204. Specifically, a mounting surface 230 of the base 204 engages a distal spring cup 232 of the flow tube body 206 in a manner that allows the spring 228 to bias the flow tube 206 in a proximal direction. In an alternative embodiment, the dummy ports 226 may be combined as a single rounded groove sized for housing the inlet ports 220 not engaged with the outlet 224. In another alternative embodiment, the distal surface of the selector module 214 includes a shallow groove circling between each of the dummy ports 226 and the outlet 224 to help guide tracking of the inlet ports 220 during adjustment/rotation when a user is selecting a pattern width/nozzle set 218.

For example, a user wishes to have a watering pattern width corresponding to the nozzle set 218*c*. The user grasps the flow tube body 206 and moves it distally, compressing the spring 228. When the flow tube body 206 is moved distally along its longitudinal axis to compress the spring 228 between the spring cup 232 and the mounting surface 230, the inlet ports 220 are disengaged from the outlet port 224 and the dummy ports 226. This disengagement allows the user to select which of the nozzle sets 218 to use by rotating the flow tube body 206 to align the desired nozzle set 218*c* with the pointer 217. When the nozzle set 218*c* is aligned with the pointer 217, the inlet port 220*c* is aligned with the outlet port 224. At this point, the user can release the flow tube 206, and the proximally directed biasing force of the spring 228 through the flow tube 206 will bias the inlet port 220*c* into engagement with the outlet port 224. In this example, when the user activates water flow to the sprinkler 200, the water entering through the inlet 202 will pass through the flow control module 208, the water-impelled oscillator motor 210, and the outlet port 224 of the selector module 214, entering the lumen 222*c* of the flow tube body 206 through the inlet port 220*c*, and exiting the sprinkler 200 through the nozzle set 218*c*.

The selector module 214 is attached to the oscillator 210, such that when water flow through the oscillator 210 causes it to oscillate, the selector module 214 also oscillates. The engagement of the inlet ports 220 of the flow tube body 206 with the selector module 214 is such that the oscillation of the oscillator 210 is translated to oscillation of the flow tube body 206. In an alternative embodiment, the selector outlet and one or more dummy outlets, if present, may protrude while the inlets on the flow tube body 206 are inset and are sized and oriented to engage the selector outlet.

It will be apparent to those skilled in the art that modifications and variations can be made in the present invention without departing from the spirit or scope of the invention. It is therefore intended that the foregoing description be regarded as illustrative rather than limiting, and that it be understood that it is the following claims, including all equivalents, that are intended to define the spirit and scope of this invention.

We claim:

1. An oscillating sprinkler comprising:

a fluid inlet, an oscillating mechanism, an engagement mechanism, a selector unit, an elongate tubular body member, and a support base;

wherein an internal channel leading through each of the fluid inlet, the oscillating mechanism, and the selector unit forms a first path of fluid communication, and wherein the elongate tubular body member comprises a single molded body structure having connected thereto a plurality of multi-nozzle series, wherein at least one of the plurality of multi-nozzle series has a number of nozzles that is different than another of the plurality of multi-nozzle series, a plurality of lumens, each of the plurality of lumens being connected in fluid communication with at least one of the multi-nozzle series, an end surface including a plurality of apertures, one aperture open to each of the lumens, such that each aperture is associated with one of the plurality of lumens and at least one of the multi-nozzle series;

a second path of fluid communication from each aperture through its associated lumen to its associated at least one of the multi-nozzle series;

wherein the engagement mechanism provides a plurality of positions for selectably providing a connection of the first path of fluid communication with one of the second paths of fluid communication, thereby providing fluid communication from the inlet to one selected multi-nozzle series.

2. The sprinkler of claim 1, wherein the plurality of multi-nozzle series is selected from one of two multi-nozzle series, three multi-nozzle series, four multi-nozzle series, five multi-nozzle series, and six multi-nozzle series.

3. The sprinkler of claim 1, wherein the lumens are symmetrically formed by walls extending substantially from a central longitudinal axis of the elongate tubular body member.

4. The sprinkler of claim 1, wherein the engagement mechanism comprises:

a spring detent member mounted on at least one of the tubular body, the selector unit, and the support base; and at least two indentations opposite the spring detent member and independently selectably engageable by the spring detent member.

5. The sprinkler of claim 1, wherein the engagement mechanism comprises:

each of the plurality of apertures embodied as a protruding inlet on the end surface of the tubular body;

an inset outlet on the selector unit sized to selectably engage the protruding inlets;

a biasing structure for biasing a selected one of the protruding inlet apertures into engagement with the inset outlet to provide a connection of the first path of fluid communication with the second path of fluid communication that is associated with the selected protruding inlet.

6. The sprinkler of claim 1, wherein the engagement mechanism comprises:

each of the plurality of apertures embodied as an inset inlet on the end surface of the tubular body;

a protruding outlet on the selector unit sized to selectably engage the inset inlets;

a biasing structure for biasing a selected one of the inset inlet apertures into engagement with the protruding outlet to provide a connection of the first path of fluid communication with one of the second paths of fluid communication.

7. The sprinkler of claim 1, wherein the engagement mechanism comprises:

an inset outlet on one of the selector unit and the tubular body; and at least two protruding inlets on the other of the selector unit and the tubular body, each protruding inlet being open to one of the lumens and sized to engage the inset outlet.

8. The sprinkler of claim 1, wherein at least one of the multi-nozzle series comprises one of a strip having nozzle apertures, a series of nozzles formed as openings in the body member, and a series of individually mounted nozzles.

9. The sprinkler of claim 1 further comprising at least one of a flow control element and a timer element.

10. The sprinkler of claim 1 wherein each of the multi-nozzle series is mounted into a longitudinal slot in a surface of the elongate tubular body member by a selected one of welding, gluing, and snap-fitting.

11. An oscillating sprinkler having a pattern select feature comprising:

a tubular member including a plurality of circumferentially spaced apart nozzle-mounting surfaces therein, an end portion including the same plurality of apertures therein and the same plurality of indents thereon, wherein, each said nozzle-mounting surface includes a series of nozzles associated therewith, and wherein the interior of the tubular member comprises a plurality of water conduit cavities, wherein each water conduit cavity is associated with one of said series of nozzles;

a generally cylindrical collar element disposed around the end portion;

a selector piece mounted inside said collar element, wherein the selector piece comprises an opening to be aligned with a selected fluid inlet, and an outwardly biased protrusion extending towards the end portion;

a water-driven oscillating mechanism for oscillating the tubular member, wherein the oscillating mechanism includes a water inlet and a water outlet, wherein the water outlet is in fluid communication with an interior channel of the selector piece and wherein the oscillating mechanism causes the selector piece to oscillate, said oscillating selector piece interacting with the indent of the end portion through the outwardly biased protrusion to oscillate the tubular member; and a support structure for supporting the tubular member.

12. The sprinkler of claim 11 further comprising at least one of a flow control element and a timer element.

13. The sprinkler of claim 11 wherein the sprinkler comprises at least three water conduit cavities.

14. The sprinkler of claim 11 wherein the opening on the selector piece comprises a cylindrical portion having an internal step, a sealing cup fitted within the cylindrical portion, an o-ring between the internal step and the sealing cup, and a rubber seal extending out from the sealing cup towards the end portion.

15. The sprinkler of claim 11 wherein each series of nozzles is mounted to one of the nozzle mounting surfaces by a selected one of welding, gluing, and snap-fitting.

16. An oscillating sprinkler having a pattern select feature comprising:

a tubular member having a plurality of circumferentially spaced apart longitudinal slots therein, and an endplate having the same plurality of apertures therein and the same plurality of indents therein, wherein each said longitudinal slot includes a series of nozzles associated therewith, and wherein the interior of the tubular member comprises a plurality of water conduit cavities, wherein each water conduit cavity is associated with one of said series of nozzles;

a cylindrical collar element mounted adjacent the endplate;

a selector piece connected inside said collar element, wherein the selector piece comprises an opening to be aligned with a selected fluid inlet and an outwardly biased protrusion extending towards the endplate, wherein the opening on the selector piece comprises a cylindrical portion having an internal step, a sealing cup fitted within the cylindrical portion, an o-ring between the internal step and the sealing cup, and a rubber seal extending out from the sealing cup towards the endplate;

a water-driven oscillating mechanism for oscillating the tubular member, wherein the oscillating mechanism includes a water inlet and a water outlet, wherein the water outlet is in fluid communication with the interior of the collar element and wherein the oscillating mechanism causes the selector piece to oscillate, said oscillating selector piece interacting with the indent of the endplate through the outwardly biased protrusion to oscillate the tubular member; and a support structure for supporting the tubular member.

17. The sprinkler of claim 16 further comprising at least one of a flow control element and a timer element.

18. The sprinkler of claim 16 wherein the sprinkler comprises at least three water conduit cavities.

19. The sprinkler of claim 16 wherein each series of nozzles mounted into one of the longitudinal slots by one of welding, gluing, and snap-fitting.

20. An oscillating sprinkler comprising:

a tubular member having a first number of nozzle mounting slots thereon, and an end portion having substantially the same first number of apertures therethrough and wherein each of the nozzle mounting slots includes a series of nozzles associated therewith, each of said series of nozzles having a different number of nozzles, and wherein the interior of the tubular member comprises a plurality of lumens, wherein each lumen is associated with one of the series of nozzles and with one of the apertures;

a selector unit comprising a fluid passage selectably in communication with each of the plurality of lumens and an engagement mechanism, said engagement mechanism being selectably engageable with the end portion in one of at least two engagement positions;

a fluid-driven oscillating mechanism for oscillating the tubular member;

wherein an oscillating movement of the oscillating mechanism causes the selector unit to oscillate, said oscillating selector piece interacting with the engagement mechanism to oscillate the tubular member.

21. An oscillating sprinkler having a pattern select feature and comprising:

a tubular member comprising a plurality of spaced apart longitudinal slots therein, a first end having the same plurality of apertures therein and the same plurality of indents therein, and a closed end, and a plurality of water conduit cavities, wherein each water conduit cavity is associated with one of said longitudinal slots;

a plurality of strips of nozzles for each of said longitudinal slots, wherein an interior side of each of the strips comprises a means for securing the strip to a longitudinal slot and an exterior side of the strips comprises outwardly projecting nozzles;

a cylindrical collar element over the first end of the tubular member;

a selector piece fitted inside said collar element, wherein the selector piece comprises an opening to be aligned with a selected aperture and an outwardly biased protrusion extending towards the first end of the tubular member;

a water-driven oscillating mechanism for oscillating the tubular member, wherein the oscillating mechanism includes a water inlet and a water outlet, wherein the water outlet is in fluid communication with the interior of the collar element and wherein the oscillating mechanism causes the selector piece to oscillate, said oscillating selector piece interacting with the indent of the first end through the outwardly biased protrusion to oscillate the tubular member; and a support structure for supporting the tubular member.

* * * * *